US005540430A

United States Patent [19]

Nichols et al.

[11] Patent Number: 5,540,430

[45] Date of Patent: Jul. 30, 1996

[54] BATTING PRACTICE STAND

[76] Inventors: Cheryl A. Nichols; Jacky R. Nichols, both of Rte. 1, Box 114, Poteau, Okla. 73053

[21] Appl. No.: 330,354

[22] Filed: Oct. 27, 1994

[51] Int. Cl.[6] ..... A63B 69/40

[52] U.S. Cl. ..... 273/26 E

[58] Field of Search ..... 273/26 R, 26 E, 273/29 R, 29 A, 126 R, 195 A

[56] References Cited

U.S. PATENT DOCUMENTS

| | | | |
|---|---|---|---|
| 1,862,044 | 6/1932 | White | 273/26 E |
| 2,017,720 | 10/1935 | Lake | 273/26 E |
| 2,974,040 | 3/1961 | Bales | 273/26 E |
| 3,006,647 | 10/1961 | Haskett | 273/26 E |
| 3,039,770 | 6/1962 | Ferretti | 273/26 R |
| 3,156,467 | 11/1964 | Rucker | 273/126 R |
| 3,345,073 | 10/1967 | Hoffman | 273/197 A |
| 4,057,248 | 11/1977 | Stoecker | 273/26 R |
| 4,258,916 | 3/1981 | Beam | 273/26 R |
| 4,647,043 | 3/1987 | Bruce | 273/26 E |
| 4,664,375 | 5/1987 | Tetreault | 273/26 E |
| 4,793,612 | 12/1988 | Hammond | 273/26 E |
| 5,076,580 | 12/1991 | Lang | 273/26 R |
| 5,106,085 | 4/1992 | Lewy | 273/26 R |
| 5,133,549 | 7/1992 | Vasquez | 273/26 E |
| 5,156,402 | 10/1992 | Hart | 273/26 R |
| 5,255,911 | 10/1993 | Preston | 273/26 E |

OTHER PUBLICATIONS

"Power Swinger" (sent by applicant).

*Primary Examiner*—Theatrice Brown

*Attorney, Agent, or Firm*—Robert Treece

[57] ABSTRACT

A portable base ball batting practice stand including a base having a post connected thereto and extending upwardly therefrom. A generally horizontal extension is connected to the post and extends outwardly therefrom. A ball is suspended by a line from the extension for one to practice batting. The base may have more than one base sections and the base sections may be hingidly attached to each other to allow the base to be folded for transport. The stand may also include a T-ball post which may be removably connected to the base.

6 Claims, 2 Drawing Sheets

BATTING PRACTICE STAND

FIELD OF THE INVENTION

The present invention relates to batting practice stands. More particularly, to a batting practice stand comprising a foldable base.

SUMMARY OF THE INVENTION

Baseball and softball are played throughout the world and are popular with both participants and spectators. This popularity is in part because the sport has supplied a wide range of legendary heros, books, movies and songs. While many of the legends and stories are questionable, one basic fact remains—to be a great ball player one must be able to hit the ball.

The ability to hit is directly related to practice. However, without expensive batting machines it is difficult to practice alone. The current invention provides an inexpensive, portable batting practice device which can also double as a T-ball stand, and the device folds up so it may be easily moved or stored.

These as well as other advantages will become apparent from the following description and accompanying drawings.

DETAILED DESCRIPTION OF THE PREFERRED EMBODIMENTS

Figure 1:
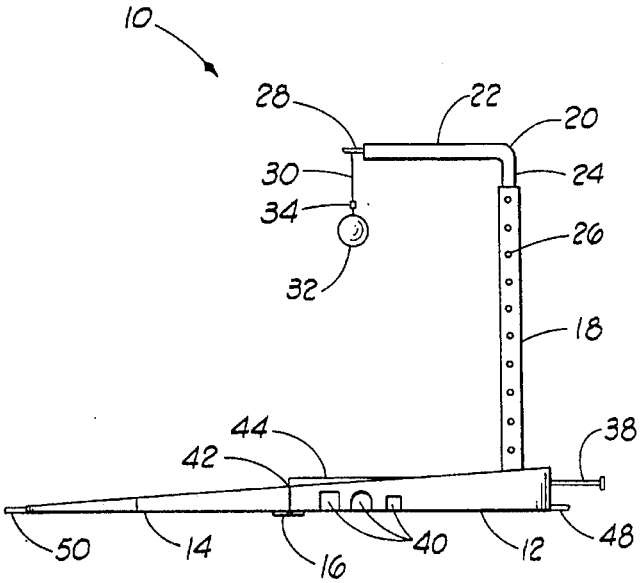
FIG. 1 is an elevational view of the apparatus of the present invention in the batting practice configuration.

Referring to the drawings in detail and to FIG. 1 in particular, reference character 10 generally designates a batting practice stand constructed in accordance with the present invention. The stand includes a generally planer base, which may be a single or a multi-part base. Shown in FIG. 1 is a two part base having main base section 12 and base extension 14 (while a two part base is shown, it should be understood that any number of base sections may be used). A vertical post 18 may be secured to a base section, 12 or 14 and extend generally upward therefrom. A generally horizontal extension should be connected to the vertical post 18.

In the preferred embodiment the extension is a separate L member, such as member 20, which is slidingly connected to the vertical post 18. In this way, the height of the horizonal member may be adjusted by sliding the L member 20 up or down relative to the vertical post 18. In this configuration the L member 20 preferably has a horizontal portion 22 and a vertical portion 24. In this way, the vertical portion 24 of the L member 20 can slide into, or over, the vertical post 18. More preferably, the vertical portion 24 of the L member 20 may be releasably attached to the vertical post 18. One method for releasably attaching the vertical portion 24 of the L member 20 to the vertical post 18 is by latching holes, such as latch hole 26 (only one latch hole 26 being designated herein). Preferably a rod, such as rod 28, extends from the horizontal portion 22 of the L member 20. In this way, a flexible or semi-ridged member 30, such as a line, string, cord, cable, chain, or plastic rod, can be pivotally attached to the rod 28 and extend downward therefrom to a ball, such as baseball 32 (for clarity, the flexible or semi-rigid member will be referred to as line 30). The line 30 should be connected such that when the baseball 32 is hit it will swing in a circular motion around the rod 28, and the connection between the line 30 and rod 28 will pivot therewith so as to keep the line from becoming entangled or shortened as it circles rod 28.

The vertical post 18 is preferably removably secured to the base 12 so that it may be removed for storage and/or transportation. To facilitate easy removal an aperture, or post holder 36, is provided in the base 12 to receive the lower end of the vertical post 18. A pin 38 may also be provided for insertion through the base 12 into the post 18 to hold the post 18 in position. In this way, the vertical post 18 is securely held when in an operating position, however by removing the pin 38 one may simply lift the post 18 and remove it from the base.

As earlier mentioned the base may be a single or multi piece base. When the base is a single piece base it should be of ample size to provide a stable environment for the batter to swing from. This may be accomplished by providing a base having sufficient room for a home plate, such as home plate 44, and batters box, such as batters box 58. In this way, the batter may stand on the base thereby stabilizing the batting practice stand 10 while practice swings are undertaken.

Figure 2:
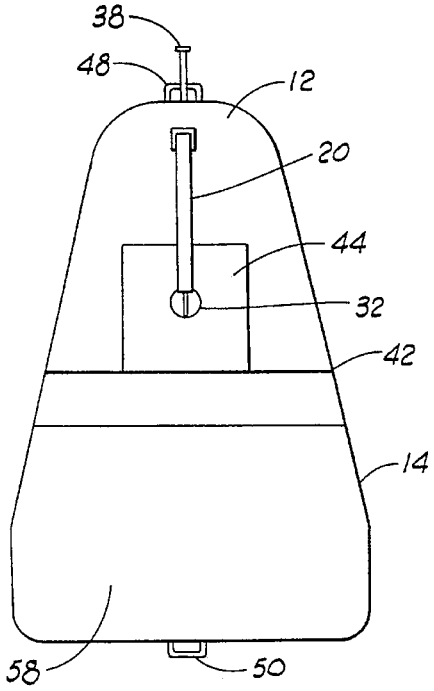
FIG. 2 is a top plan view of the apparatus of the present invention.

In order to facilitate storage and transportation it is preferable that the base is a multi piece base. For example, as is shown in FIG. 2, a hinge line 42 can divide the main base 12 from the base extension 14. Hinges such as hinge 16 (only one hinge being designated in FIG. 1) may be provided to allow the base to be folded for storage or transportation. Preferably the hinge 16 is on the bottom of the base, so the base may be folded into a compact package, and unfolded to provide a stable and platform. Sufficient hinges, or a long enough hinge, such as a piano type hinge, should be provided to withstand the force exerted by a person standing on the unfolded base.

Handles may be provided for carrying the stand. When the base is a multi piece base, preferably more than one handle is provided and the handles are positioned such that when the base is folded the handles meet. In this way, the handles may be grasped to hold the base in a folded position. For example, as shown in FIG. 2, handle 48 and handle 50 meet when the base is folded along hinge line 42. A latch or catch (not shown) may also be provided to lock the base in a folded position.

Figure 3:
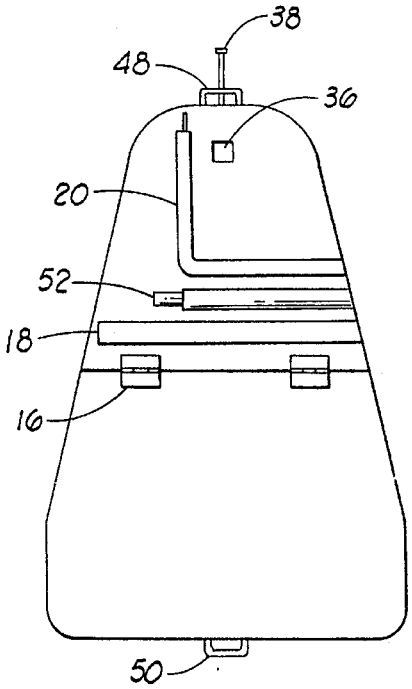
FIG. 3 is a bottom plan of the apparatus of the present invention with the poles stored.
Figure 4:
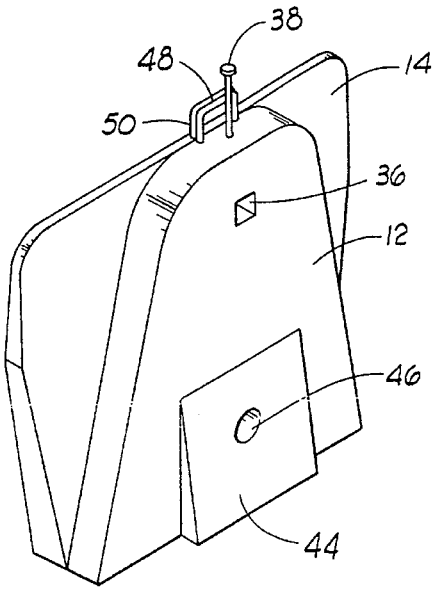
FIG. 4 is a perspective view of the apparatus of the present invention in a folded position.

Referring now to FIG. 3, pole storage, such as storage area 40, may be provided so the various members utilized with the stand 10 may be stored with the base 12, and preferably concealed within the base when it is in a folded position. Various means may be used to secure the poles and accessories to the base such as clips, snaps, straps, velcro or other similar means. As may be seen in FIG. 4, the post holder 36 is provided to accept the vertical post 18 when in an operating position, in addition, a T-ball pole holder 46 may also be provided so the stand may serve the dual function of batting practice stand and T-ball stand.

Figure 5:
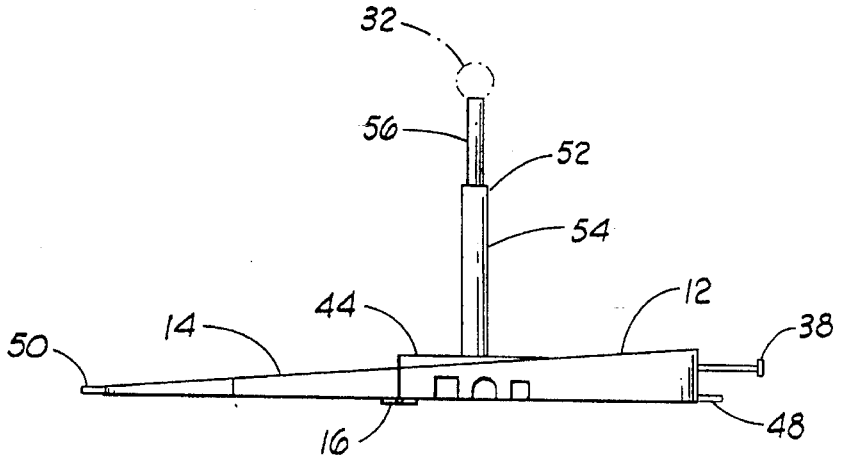
FIG. 5 is an elevational view of the apparatus of the present invention in the T-ball configuration.

FIG. 5 illustrates the stand in its T-ball configuration. In this configuration a T-ball pole 52 may be attached to the base 12. Preferably the T-ball pole 52 is attached to about the center of the home plate portion 44 of the base 12. In the most preferred configuration, the T-ball pole is adjustable so the height of the ball may be adjusted according to the height of individual batters. This may be accomplished by providing an upper T-ball pole 56 and a lower T-ball pole 54. The upper T-ball pole 56 preferably slides into or over lower T-ball pole 54 to provide adjustability. At least a portion of the upper T-ball pole 56 is flexible so if a bat comes into contact with that portion of the pole 56 it will flex. Means should be provided for holding the upper pole 56 in position after it is adjusted to the desired height. This may be done by any conventional means, such as a elastic collar, clamps or other similar devices.

Figure 6:
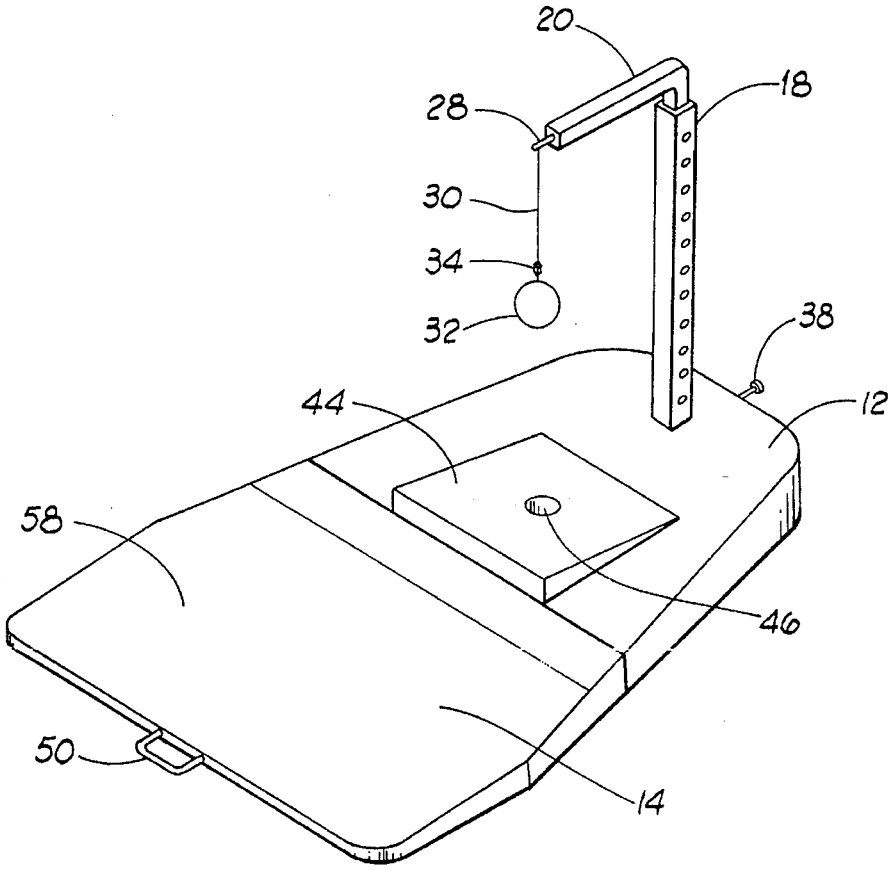
FIG. 6 is a perspective view of the apparatus of the present invention in the batting practice configuration.

As shown in FIG. 6, the stand 10 may be used for batting practice, but also for actual game play. This may be accomplished by inserting a connector, such as connector 34 into the line 30 so the ball 32 may be released when struck by a bat. The connector 34 is preferably a snap in type connector which will support the weight of the ball until the added force of impact when a bat is encountered.

In an alternative embodiment the connector 34 will only release when manually released, and thus provides a way for replacing an existing ball with a new ball. Thus, if one chooses to change from a baseball to another type of ball (such as a softball, or tennis ball), or if the existing ball becomes damaged, the ball may be released and the replacement ball may be attached.

As shown in FIG. 6, preferably the vertical post 18, is rectangular or square in cross section. This provides additional resistance to torque caused during batting practice. While other cross sectional shapes may be used, such as round, oval, triangular and etc., the rectangular post is preferred because it is commonly available and provides sufficient torque resistance.

Changes may be made in the combinations, operations and arrangements of the various parts and elements described herein without departing from the spirit and scope of the invention as defined in the following claims.

We claim:

1. A combination,batting practice tethered ball stand and T-ball stand apparatus, comprising:

a base of sufficient size for a batter to stand on thereby stabilizing said apparatus when in use; said base being comprised of first and second sections hingedly connected to allow said base to be folded, said first base section including a batters box for a batter to stand when practicing batting with said apparatus;

first connecting means for removably attaching a first post to said second base section, said first post extending vertically upwards from said second base section, said first post being adapted to support a ball on its upper end to define a T-ball stand for use in game play;

second connecting means on said second base section for attaching an L-shaped member to said second base section, said L-shaped member having first and second portions, said first portion extending substantially vertical from said second base section and said second portion extending perpendicular from the first portion and having a free end;

a tether line having a first end rotatably attached to said second portion free end and a second end having a ball attached thereto;

said first and second connecting means being spaced a predetermined distance apart on said second base section;

said second base section comprising a home plate area having an aperture therein for removably receiving a lower end of said T-ball stand;

said T-ball stand and tethered ball stand being alternately attached to said second base section when said apparatus is used by a batter.

2. The batting practice apparatus of claim 1, wherein said base includes a handle attached to each of said sections.

3. The batting practice apparatus of claim 1, wherein said base includes a storage area for storing said posts in said base.

4. The batting practice apparatus of claim 1, wherein said base tapers from a thickened area to a thinned area and wherein said first and second posts are connected to said thickened area.

5. The batting practice apparatus of claim 1, wherein said first post and said first portion of said L-shaped member is defined by at least two adjustable telescoping sections whereby the height of said stands can be adjusted to thereby support the ball at various heights above said base.

6. The batting practice apparatus of claim 1, including means connecting said ball to said tether for releasing said ball from said tether when said ball is hit by a batter.

* * * * *